United States Patent [19]

Porowski

[11] Patent Number: 4,781,046

[45] Date of Patent: Nov. 1, 1988

[54] TUBE EXPANDER

[75] Inventor: Jan S. Porowski, Pittsburgh, Pa.

[73] Assignee: O'Donnell & Associates, Inc., Pittsburgh, Pa.

[21] Appl. No.: 156,530

[22] Filed: Feb. 16, 1988

[51] Int. Cl.[4] ..... B21D 39/20; B23P 11/02; B23P 15/26; B23P 17/00

[52] U.S. Cl. ..... 72/58; 29/727

[58] Field of Search ..... 29/157.3 C, 157.4, 523, 29/726, 727; 72/54, 58, 61, 62, 59

[56] References Cited

U.S. PATENT DOCUMENTS

| | | | |
|---|---|---|---|
| 2,458,854 | 1/1949 | Hull et al. | 72/58 |
| 4,387,507 | 6/1983 | Kelly | 29/727 |
| 4,567,631 | 2/1986 | Kelly | 72/58 X |
| 4,685,191 | 8/1987 | Mueller et al. | 72/58 X |

*Primary Examiner*—E. Michael Combs

*Attorney, Agent, or Firm*—Joseph J. Carducci

[57] ABSTRACT

A tube expander capable of simultaneously applying a plurality of selected radial pressures outwardly at a plurality of sections of a tube interior to provide selected expansions of the sections of the tube.

2 Claims, 2 Drawing Sheets

TUBE EXPANDER

BACKGROUND OF THE INVENTION

1. Field of the Invention

This invention relates to a novel tube expander capable of simultaneously applying a plurality of selected radial pressures outwardly at a plurality of sections of a tube interior to provide selected expansions of said sections of said tube.

2. Description of the Prior Art

It is old to apply a radial force outwardly from the interior of a tube at a selected portion thereof in order to permanently enlarge the diameter of said selected portion of said tube. This is often done, for example, in sealing tubes-to-tubesheets in heat exchangers by expanding that portion of the tube within the hole, or opening, of the tubesheet beyond its elastic limit. Such a procedure is illustrated in "Heat-exchanger tube-to-tubesheet connections" by Stanley Yokell in Chemical Engineering, Feb. 8, 1982, pages 78 to 94. In some cases, for example, when the tube is welded to the tubesheet, it may be desirable also to expand that portion of the tube extending immediately beyond the stub lying within the opening in the tubesheet. To do this using the tube expanders discussed by Stanley Yokell would require a two-step process. After expanding that section of the tube within the hole in the tubesheet, the tube expander would then be moved to that portion of the tube immediately beyond the stub lying within the hole in the tubesheet, and the procedure would be repeated. I have found that by using the novel tube expander defined and claimed herein, a plurality of selected radial pressures can be simultaneously applied on selected sections of the tube interior to obtain controlled tube expansions of said selected sections with little or no adverse effects to the tube, the tubesheet or the weld joining the two.

SUMMARY OF THE INVENTION

I have found that the novel tube expander claimed herein is capable of simultaneously applying a plurality of selected radial pressures at a plurality of sections of the tube interior and comprises a central rod assembly having a plurality of diameters, a first rigid ring securedly attached around one end of said control rod assembly, a second rigid ring loosely mounted around said central rod assembly remote from said first rigid ring, at least one elastomeric ring loosely mounted around at least one of said central rod assembly diameters, at least one elastomeric ring loosely mounted around at least another of said central rod assembly diameters, a third rigid ring loosely mounted around said central rod assembly disposed between said elastomeric rings and in contact therewith, the surface area of said third rigid ring in contact with said first elastomeric ring being different in size than the surface area of said third rigid ring in contact with said second elastomeric ring, and means for moving said second rigid ring and said central rod assembly axially in directions relatively opposite to each other sufficient to compress said elastomeric rings.

BRIEF DESCRIPTION OF THE INVENTION

Figure 1:
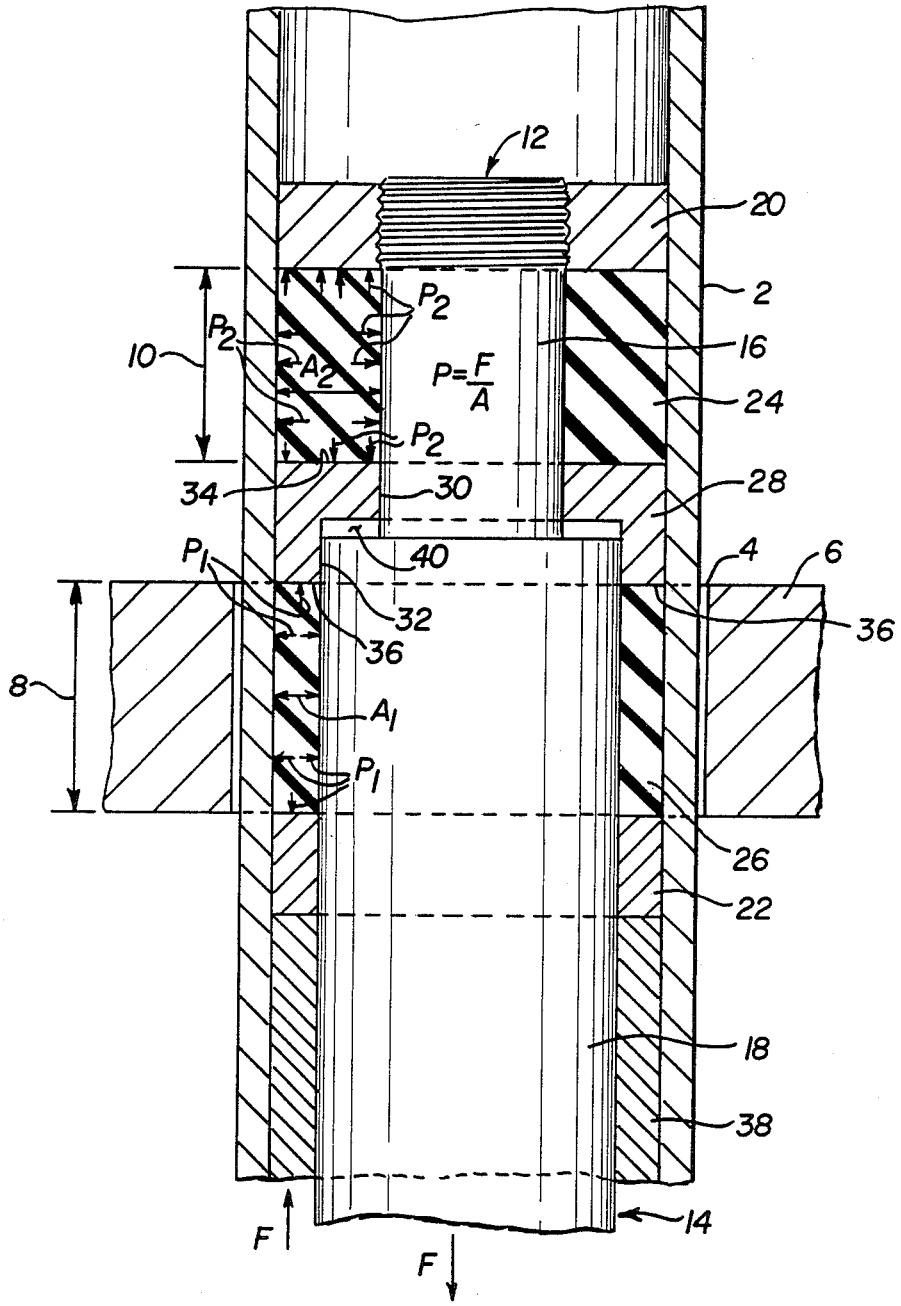
FIG. 1 is an elevational view of the novel tube expander defined and claimed herein disposed within a tube that is to be selectively expanded in more than one section thereof.

Referring to FIG. 1, there is shown a metal (iron) tube 2 passing through an opening, or hole, 4 of a tubesheet 6 of a shell-and-tube heat exchanger (not shown). Inserted therein is the novel tube expander of the present invention capable of simultaneously expanding the diameter of the section 8 lying within the opening 4 of tubesheet 6 and the section 10 of tube 2 lying outside of tubesheet 6 but adjacent thereto, using different levels of radial pressure therefor.

The novel tube expander 12 comprises a central rod assembly 14 composed of a section 16 having a diameter smaller than the diameter of the remaining section 18 thereof. Although the central rod assembly 14 is shown as a unitary element, it is understood that the same can be made of two or more parts. For example, sections 16 and 18 can be separate and distinct entities that can then be assembled to obtain the desired central rod assembly 14. On the other hand, the central rod assembly 14 can be prepared using an elongated metal rod having a diameter equal to the diameter of section 16, which is then inserted in a metal tube having the same outer diameter as section 18 and an inner diameter corresponding to the diameter of section 16.

Securedly attached around one end of section 16 of central rod assembly 14 is a first rigid ring 20 having an outer diameter slightly smaller than the inner diameter of tube 2. As shown, rigid ring 20 is threaded to one end portion of central rod assembly 14. If desired, rigid ring 20 can be attached to the central rod assembly 14 by any suitable means or can be made integral therewith. Remote from rigid ring 20 is a second rigid ring 22 loosely mounted around section 18 of central rod assembly 14 and axially moveable thereon. Loosely mounted around section 16 of central rod assemble 14 and axially moveable thereon is a first elastomeric ring 24. Similarly, loosely mounted around section 18 of central rod assembly 14 is a second elastomeric ring 26 axially moveable thereon. Each of the elastomeric rings has an outer diameter slightly smaller than the inner diameter of tube 2. The lengths of the elastomeric ring facing the adjacent tube surface can vary depending on the lengths of the sections of the pipe to be expanded. The elastomeric rings can be made of any material, natural or synthetic, that can be compressed and expanded when force is applied thereto but that will return substantially to its original shape when such force is released. A suitable elastomeric ring could be made of natural or synthetic rubber.

Disposed between elastomeric rings 24 and 26, loosely mounted around the central rod assembly 14 and axially moveable thereon is a third rigid ring 28. The inner surface 30 of one section of rigid ring 28 is in contact with the adjacent surface of section 16 of central rod assembly 14, while the remaining inner surface 32 of the remaining section of rigid ring 28 is in contact with the adjacent surface of section 18 of central rod assembly 14. While rigid ring 28 is shown to be a unitary member, it can be composed of more than one part. For example, a rigid ring 28 assembly can be composed of one part surrounding section 16 of the central rod assembly 14 and another part surrounding section 18 of the central rod assembly 14. As shown in FIG. 1, it can be seen that the surface area 34 ($A_2$) of rigid ring 28 in contact with elastomeric ring 24 is greater than the surface area 36 ($A_1$) of rigid ring 28 in contact with elastomeric ring 26. In a preferred embodiment, a retaining sleeve 38 in contact with rigid ring 22 is loosely mounted around section 18 and is axially moveable thereon. To permit desired axial movement of rigid ring 28 on both sections 16 and 18 of central rod assembly 14, the members forming a part of the claimed novel tube expander are designed and assembled to provide sufficient free space 40 adjacent to the juncture of sections 16 and 18 of central rod assembly 14.

In operation, to provide for the selected expansions of sections 8 and 10 of tube 2, means are applied to tube expander 12 sufficient to compress elastomeric rings 24 and 26. This is done, using any suitable means, by moving rigid ring 22, and retaining sleeve 38, if used, and the central rod assembly 14 axially in directions axially relatively opposite to each other. Thus, means can be used to maintain rigid ring 22, and retaining sleeve 38, if used, in a fixed position, while a force F, for example, a mechanical or hydraulic force, is brought to bear on the central rod assembly 14 to axially move the same against the retaining force of rigid ring 22, and retaining sleeve 38, if used. An example of a suitable means that can be used to obtain the desired movement in the novel tube expander herein is illustrated in FIG. 6 on page 84 of the Yokell article cited above.

Figure 2:
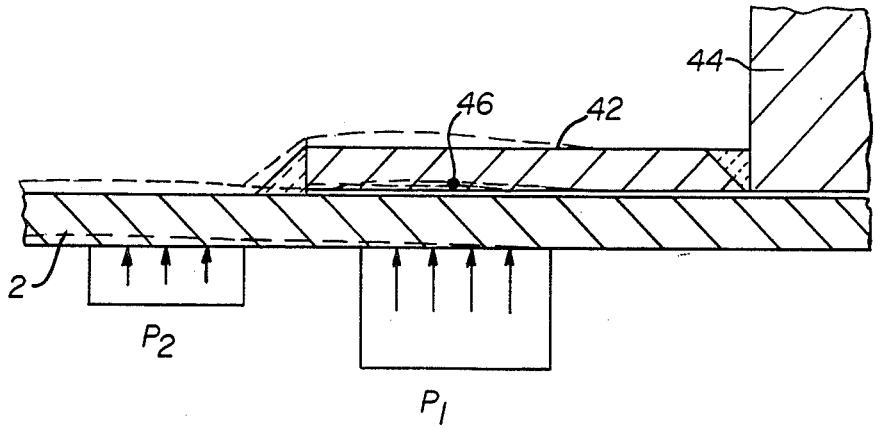
FIG. 2 is a schematic representation showing the effect of applying selective outward radial pressures in a tube welded to a stub in accordance with the invention claimed herein.

As can be seen from FIGS. 1 and 2, when the desired movement, as defined above, is obtained, in a situation wherein tube 2 is welded to a stub 42 which, in turn, is welded to a pressure vessel shell 44, elastomeric rings 24 and 26 will be compressed and will bulge radially outwardly, exerting pressure on the adjacent inner walls of metal tube 2, resulting in the expansion of the respective sections 10 and 8 of tube 2. Since the surface area $A_2$ of rigid ring 28 in contact with elastomeric ring 24 is greater than the surface area $A_1$ of rigid ring 28 in contact with elastomeric ring 26, it is evident that the pressure $P_2$ resulting from the compression of elastomeric ring 24 will be smaller than the pressure $P_1$ resulting from the compression of elastomeric ring 26.

The results flowing from the above can further be observed in FIG. 2. As can be seen, sufficient radial pressure $P_1$ is brought to bear in that section of the tube adjacent the stub 42 in order to obtain an effective seal 46 therebetween. A similar amount of expansion is obtained in the tube section adjacent thereto but with the lower pressure $P_2$, since little or no resistance thereto is met from stub 42. As a result thereof, the tube 2 outer surface profile becomes concave and thus compressive strains are introduced in the weld and the heat-affected zone in the tube 2. Therefore the possibility of stress corrosion cracking is greatly reduced or even eliminated.

Figure 3:
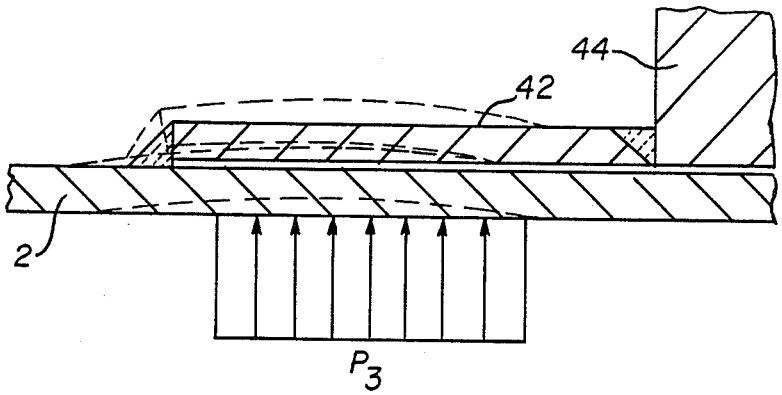
FIG. 3 is a schematic representation showing the effect of applying a single uniform outward radial pressure on a tube welded to a stub solely in the section of the tube in contact with the stub.

But note from FIG. 3 what happens when a single, uniform radial pressure $P_3$ is brought to bear on tube 2 solely within the section of the tube in immediate contact with stub 42, for example, using a tube expander of the type illustrated by Yokell in FIG. 6 referred to above. When the expansion is limited to the tube 2 in the section thereof in contact with stub 42, the tube 2 outer surface profile becomes convex, which introduces tensile strains in the weld and in the heat-affected zones in the tube 2. The resulting tensile stresses endanger the weld and the heat-affected zone and produce stress corrosion cracking therein.

Figure 4:
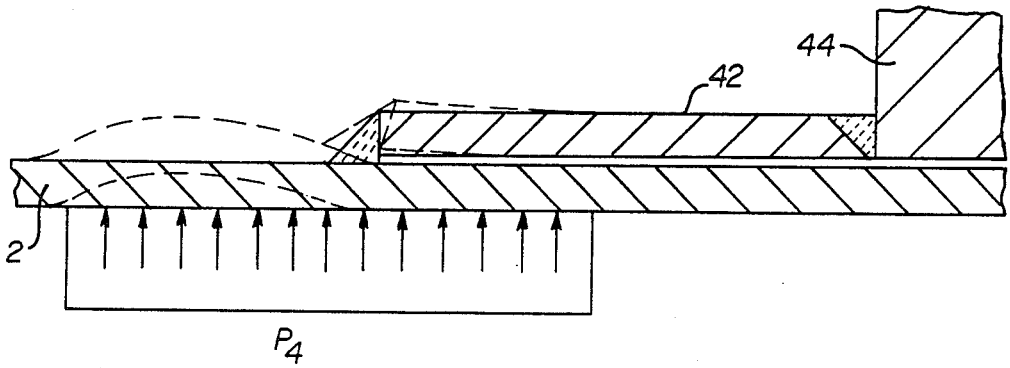
FIG. 4 is a schematic representation showing the effect of applying a single uniform outward radial pressure on a tube welded to a stub both in the section in contact with the stub and in a section extending outwardly therefrom.

If a single, uniform radial pressure $P_4$ is brought to bear on the tube, both on the section in immediate contact with stub 42 and the section adjacent thereto, as shown in FIG. 4, the desired results obtained herein, as illustrated in FIG. 2, would not be obtained. Note that there would be an overexpansion in the tube 2 extending beyond the section in contact with the stub 42 while there would be insufficient expansion of the tube section in immediate contact with the stub 42, so that no effective seal would be obtained therebetween. And even if an attempt were made using a device, such as shown by Yokell, above, sequentially, to first apply a radial pressure to the tube section in contact with the stub 42 and then to the section of the tube adjacent thereto, the undesired results at the end of the first stage described and illustrated above in FIG. 3 cannot be eliminated. Moreover, the time involved in a two-state operation would be greater than the time required to operate the novel tube expander claimed herein.

Although only two elastomeric rings and a single rigid ring loosely mounted around the central rod assembly therebetween have been described herein, it is within the purview of my invention to use a plurality of such elastomeric and rigid rings provided that at least one rigid ring similar to rigid ring 28 is also used and that each elastomeric ring be in contact with two rigid rings. In all cases, the outside diameters of each of the rings defined herein are substantially equal to each other and slightly less than the inner diameter of the tube to be subjected to selected expansions. Each elastomeric ring would be in contact with the two adjacent rigid rings, as shown in FIG. 1. Only one retaining sleeve would be used in any case and it would always be remote from rigid ring 20 and beyond the last rigid ring 22 loosely mounted around central rod assembly 14. It is also within the purview of my invention to provide a central rod assembly having more than the two diameters shown in FIG. 1, in which case an additional rigid ring similar to rigid ring 28 would be used adjacent the juncture of each two sections of the central rod assembly having the different diameters Obviously, then, a large number of different radial pressures can be brought to bear on selected sections of pipe 2 to control local expansions therein.

Obviously, many modifications and variations of the invention, as hereinabove set forth, can be made without departing from the spurt and scope thereof, and therefore, only such limitations should be imposed as are indicated in the appended claims.

I claim:

1. A tube expander capable of simultaneously applying a plurality of selected radial pressures at a plurality of sections of a tube interior which comprises a central road assembly having a plurality of diameters, a first rigid ring securedly attached around one end of said central rod assembly, a second rigid ring loosely mounted around said central rod assembly remote from said first rigid ring, at least one first elastomeric ring loosely mounted around at least one of said central rod assembly diameters, at least one second elastomeric ring loosely mounted around at least another of said central rod assembly diameters, a third rigid ring having portions thereof loosely mounted around each of said central rod assembly diameters disposed between said elastomeric rings and in axial contact therewith, the surface area of said third rigid ring in contact with said first elastomeric ring being different in size than the surface area of said third rigid ring in contact with said second elastomeric ring, said at least one first elastomeric ring being in axial contact with said first rigid ring, said at least one second elastomeric ring being in axial contact with said second rigid ring and means for moving said second rigid ring and said central rod assembly axially in directions relatively opposite to each other sufficient to compress said elastomeric rings.

2. The tube expander of claim 1 wherein a retaining sleeve is loosely mounted around said central rod assembly remote from said first rigid ring and beyond said second rigid ring.

* * * * *